US005839427A

United States Patent [19]

Shorts

[11] Patent Number: 5,839,427

[45] Date of Patent: Nov. 24, 1998

[54] ARTIFICIAL EMBER BED

[75] Inventor: Joseph Shorts, Woodstock, Ga.

[73] Assignee: American Gas Log Company, Inc., Lithonia, Ga.

[21] Appl. No.: 996,627

[22] Filed: Dec. 23, 1997

[51] Int. Cl.[6] ..... F24C 3/00

[52] U.S. Cl. ..... 126/512; 126/92 R; 126/152 B; 431/125

[58] Field of Search ..... 126/512, 92 R, 126/92 AC, 92 A, 540, 541, 152 A, 152 B; 431/125

[56] References Cited

U.S. PATENT DOCUMENTS

| | | | |
|---|---|---|---|
| 3,583,845 | 6/1971 | Pulone | 126/512 |
| 4,971,031 | 11/1990 | Richardson | 126/512 |
| 5,000,162 | 3/1991 | Shimek et al. | 431/125 |
| 5,081,981 | 1/1992 | Beal | 126/512 |
| 5,321,520 | 6/1994 | Barth et al. | 126/512 |
| 5,469,838 | 11/1995 | Broadbent et al. | 126/512 |

OTHER PUBLICATIONS

American Gas Log Co. Advertisement, "Best Fire," 2 pp.
American Gas Log Co Installation & Operating Instructions for "Best Fire," 6 pp.
Thermafiber LLC Material Safety Data Sheet, Feb. 3, 1997, 2 pp.
Porcelain Enamel Institute, Inc. Data Bulletin PEI 502 "Properties of Porcelain Enamel," 2pp.
Porcelain Enamel Institute, Inc. Data Bulletin PEI 504 "Properties of Porcelain Enamel," 2 pp.
Mobay Chemical Corporation Material Safety Data Sheet, Dec. 30, 1985, 4 pp.
McNichols Co., Catalog Excerpt, Expanded Metal Grating, 2 pp.

*Primary Examiner*—James C. Yeung
*Attorney, Agent, or Firm*—Isaf, Vaughan & Kerr

[57] ABSTRACT

An artificial ember bed (5) for use within a fireplace (7) is disclosed. The fireplace will include a burner (12, 13) positioned below an elevated log grate (19), on which at least a pair of spaced artificial logs (20, 21) will be positioned. Situated in the space defined by, and between the logs will be an ember bed support grate (24), having an elevated surface on which a plurality of non-combustible artificial embers (25) will be disposed such that in use they will glow to create the visual appearance of glowing embers within the fire. The ember bed support grate may be constructed with a Z-shaped or a C-shaped geometry, or may include a pair of bifurcated legs (33, 34), or a pair of spaced legs (36, 37) for supporting the ember bed support grate on the log grate within the fireplace. In addition, the ember bed support grate can be fashioned as a planar grate, supported either on the logs, or received within notches (39) defined within opposed faces of the logs when situated atop the log grate.

17 Claims, 2 Drawing Sheets

ARTIFICIAL EMBER BED

FIELD OF THE INVENTION

This invention relates in general to fires constructed of artificial or ceramic gas logs. The invention provides a raised and artificial ember bed in a space defined between a spaced pair of gas logs positioned within a fireplace, for example, for improving the aesthetic appearance and the performance of the gas logs in use.

BACKGROUND OF THE INVENTION

Man has long been drawn to fire as a source of heat, for cooking, and, more recently, to sit beside at home during winter nights. Although the pleasures of a warm fire on a winter evening are many, the user of the fireplace must gather, or store, a supply of firewood sufficient to last for at least the day's fire, if not for the entire season. Moreover, the more the fireplace is used, the more ash and soot are produced, all of which must be continuously cleaned out of the fireplace.

As a natural outgrowth of man's increased use of fireplaces within their homes, primarily for the purposes of providing heat or for aesthetics, the use of artificial/ceramic vented gas logs has arisen in which a combustible fuel source, for example a fuel gas, to include natural gas and liquid propane gas, is passed into a burner which emits a flame which is passed under and around at least two, and preferably more, stacked artificial/ceramic gas logs decorated to appear as whole logs or split logs of any desired size, shape, or appearance capable of being manufactured. However, the use of gas logs, by themselves, has proven to be unsatisfactory in that they do not produce the glowing embers which improve the aesthetic appearance of a fire, nor provide the warm glow commonly associated with fireplaces. Moreover, gas log fires do not typically provide a great deal of radiant heat for heating a room. Thus, over time, and in order to improve the appearance of the fire, the use of burner pans positioned beneath a log grate within the fireplace arose, such that a burner pipe was enclosed in a non-combustible material, for example sand, so that the gas seeps through the sand whereupon it is combusted. A non-combustible material, typically a mineral wool or other type of man-made mineral or vitreous fiber, is positioned atop the sand within the burner box, or pan, which material takes on the appearance of a plurality of glowing embers when heated by the gas flame of the fireplace.

Although the use of artificial ember beds below the log grates on which artificial logs are placed improved the aesthetics, and to some extent the heat exchange performance of the fireplace, the problem still persisted in that the "embers" were positioned below the log grate, and never gathered on the logs themselves, as commonly happens with real wood fires, so the fire still lacks in visual appeal. Moreover, fireplaces which use gas burners and gas logs have the drawback of allowing carbon to build up or cake on the exterior of the log, which will require cleaning over time. This results from the incomplete combustion of the combustion gas because the fire does not sustain a sufficient level of temperature to fully combust all of the fuel, and its by-products, resulting in the deposit of carbon on the logs, and possibly elsewhere within the fireplace. Also, fireplaces using artificial gas logs still tend to be deficient in providing a good source of radiant heat for warming a room in which the fireplace is used, when compared with traditional wooden or log fueled fires.

What is needed, therefore, but seemingly unavailable in the art, is a means of providing an artificial ember bed positioned above the log grate, and with respect to the logs such that it appears to be part of a natural wood fire to improve the aesthetic appearance of the fire. What is also needed, but unavailable in the art, is a means of doing so which provides for improved radiant heat performance for heating the room in which the fireplace is used, as well as improving both the thermal and catalytic efficiencies of the fireplace such that all of the fuel of combustion is completely combusted, thus minimizing, if not eliminating, the build up of carbon and soot on the gas logs, as well as on the surfaces and/or the flue of the fireplace.

SUMMARY OF THE INVENTION

The present invention overcomes some of the deficiencies of the prior art artificial or gas log fireplaces by providing an improved artificial ember bed for use within a fire constructed of gas logs which is easy to install and use, improves the aesthetic appearance of the fire, and also improves the radiant heat performance, and catalytic efficiency of the fire. The present invention accomplishes these objects with a degree of simplicity and ease of use heretofore unknown in the art, yet which significantly enhances both the performance and appearance of a gas log fire within either masonry, or pre-fabricated fireplaces, or in any other "fireplace" type setting, whether commercial or residential in nature.

In a preferred embodiment, the artificial ember bed of this invention includes at least a spaced pair of artificial, or ceramic, gas logs supported on a log grate within a fireplace. A gas burner is positioned within the fireplace, and below the log grate on which the gas logs are situated. At least a portion of an ember bed support grate is spaced above the log grate in the space defined by and between the artificial logs. A plurality of non-combustible embers are disposed on the ember bed support grate which create the visual appearance of a bed of glowing embers positioned up off of the log grate and on and as a part of the artificial logs when a fire is lit, and which improves the catalytic efficiency of the fireplace by affording a degree of catalytic efficiency far greater than that available with the known gas log fireplaces, and which also improves the radiant heat performance of the fire by directing radiant heat off of the ceramic gas logs, as well as off of the surrounding walls of the fireplace, and outward into the room in which the fireplace is situated.

In a first embodiment, the ember bed support grate comprises a first member constructed and arranged to be received on the log grate, a second member extending perpendicularly upwardly away from the first member, and a third member extending perpendicularly away from the second member, and being spaced from and parallel to the first member for raising the ember bed upwardly off of the log carrying surface of the log grate. A plurality of non-combustible artificial embers is disposed on the third member of the ember bed support grate, thus creating a raised artificial ember bed. So constructed, the ember bed support grate can be either Z-shaped, or C-shaped.

In a second embodiment, the ember bed support grate may have a pair of spaced legs, or a pair of bifurcated legs, which extend downwardly away from a planar, substantially horizontal portion of the grate on which the "embers" are disposed, and adapted for being received on the log grate to elevate the ember bed support grate above the log grate, in the space defined between the two gas logs within the fireplace.

In still another embodiment, the ember bed support grate will comprise a planar grate which may be supported on the gas logs themselves, and over which the non-combustible artificial embers are distributed for creating the appearance of embers positioned on two logs, or pieces of split firewood as desired.

In still another embodiment, at least one ember bed support grate receiving notch is formed within the opposed faces of the artificial/ceramic gas logs, the notches on each gas log facing toward each other so that the planar ember bed support grate is received within the notches of each gas log, and supported thereon, and over which a plurality of the non-combustible embers may be disposed in random fashion.

So constructed, the ember bed support grate may be formed of expanded metal, and will be porcelain enamel coated to improve heat radiance performance, as well as extending the life of the expanded metal material by protecting it from the gas flame and from oxidation and corrosion.

The non-combustible embers will be selected from one of the group of non-combustible materials consisting of vitreous fiber, mineral wool, man-made mineral wool, man-made vitreous fiber, and ceramic fiber if so desired. The gas logs will be of a ceramic material, and preferably made of a refractory cement, and will be vented, in known fashion.

It is, therefore, an object of the present invention to provide an improved artificial ember bed which improves the visual/aesthetic appearance of a gas log fire.

It is another object of the present invention to provide an improved artificial ember bed which improves the radiant heat performance of the fire.

Yet another object of the present invention is to provide an improved artificial ember bed which increases the catalytic efficiency of the fire for more fully combusting the fuel of combustion used in the fire, as well as preventing the build-up of carbon on the gas logs resulting from incomplete combustion of the fuel.

Still another object of the present invention is to provide an improved artificial ember bed which is simple in design and construction, is easy to fabricate and use, and is rugged and durable in structure and use.

The present invention accomplishes these objects, among others, while providing for a simple rugged, durable and aesthetically pleasing artificial ember bed for use in fires constructed of gas logs which improves the radiant heat and catalytic performance of the fire. Other objects, features, and advantages of the present invention will become apparent upon reading the following specification, when taken in conjunction with the accompanying drawings.

DETAILED DESCRIPTION

Figure 1:
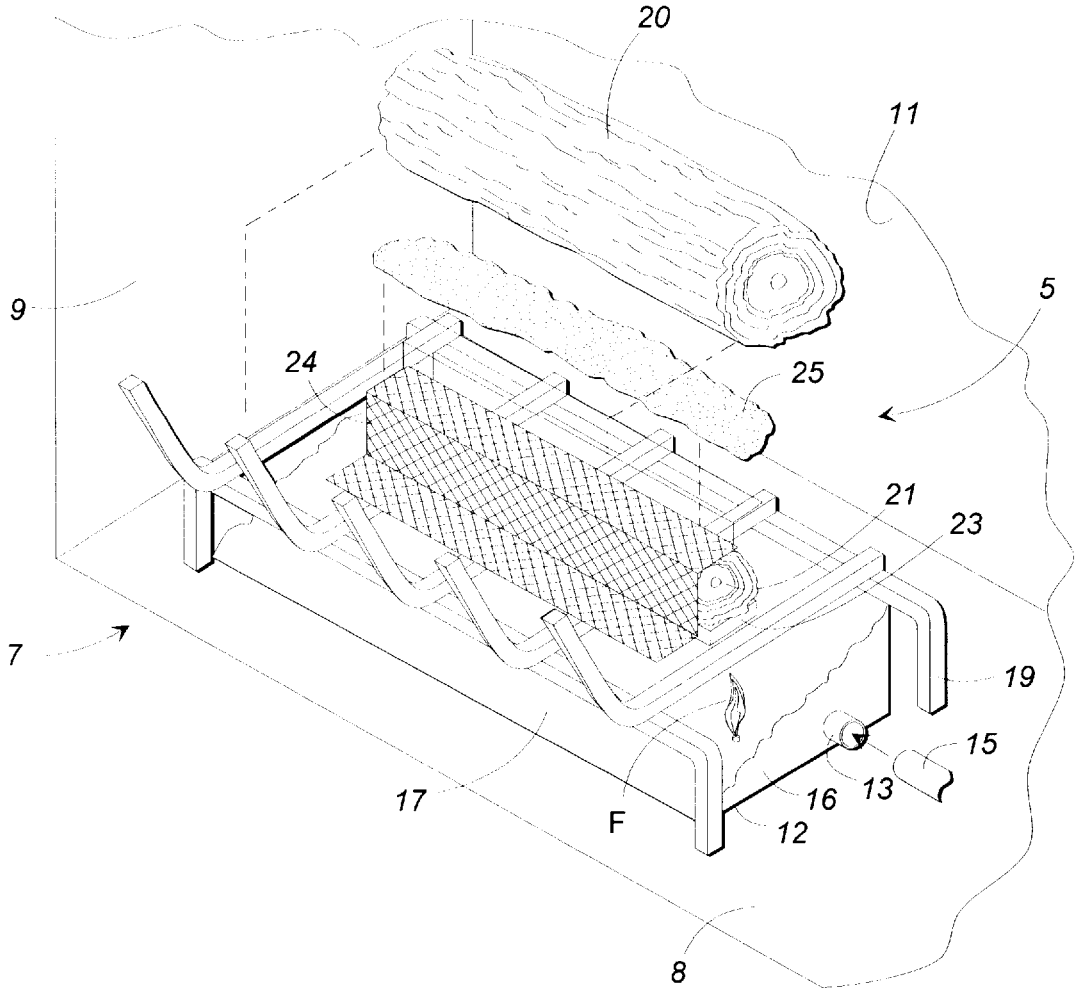
FIG. 1 is a partially exploded perspective view of an artificial ceramic gas log fire situated within a fireplace, illustrating a first embodiment of the artificial ember bed of this invention.

Referring now in detail to the drawings, in which like reference numerals indicate like parts throughout the several views, numeral 5 of FIG. 1 illustrates a first embodiment of the artificial ember bed for use with a fire constructed of gas logs of this invention. Accordingly, and as shown in FIG. 1, artificial ember bed 5 is situated within a fireplace 7, which can be, but is not limited to, a masonry or a pre-fabricated fireplace. Fireplace 7 is partially illustrated, as fireplaces are well known, fireplace 7 having a bottom wall 8, which may form a part of a hearth (not illustrated) of the fireplace, an upstanding side wall 9, and an upstanding rear wall 11, the fireplace being constructed in conventional fashion to include a second opposed side wall (not illustrated), as well as an adequate damper and flue structure for directing the combustion by-products and waste gas upward and through the flue, and out of the structure in which the fireplace is situated.

Still referring to FIG. 1, as this is an artificial fire which utilizes gas as a source of combustion fuel, in conjunction with ceramic or artificial logs, a burner pan 12 is positioned on bottom wall 8 of the fireplace, having a contiguous rear wall which extends upwardly toward the under surface of a fireplace/log grate 19, positioned above at least a portion, if not the entirety, of burner pan 12. An elongate gas/burner pipe 13 extends along the length of the burner pan, and may be supported above the base of the burner pan with conventional supports or brackets if so desired. If no such pipes or brackets are used, the burner pipe can be positioned atop the sand base 16 received within the burner pan, and which also buries the burner pipe therewithin, in known fashion.

A plurality of artificial embers 17 are disposed over the exterior surface of sand bed 16, the embers 17 being formed of a non-combustible material, to include mineral wool, and other vitreous fibers which will not burn or combust in a fire fueled by natural gas, liquid propane gas, and the other known fuel gases used within artificial fireplaces. Thus, artificial embers 17 can include mineral wool, man-made mineral fiber (MMMF), and man-made vitreous fiber (MMVF), vitreous fiber being made in known fashion from slag and/or basalt mixtures, and formed as a "wool" or fibrous substance which will glow when exposed to a source of combustion, and present the appearance of an ember, yet which will not melt or burn.

Figure 6:
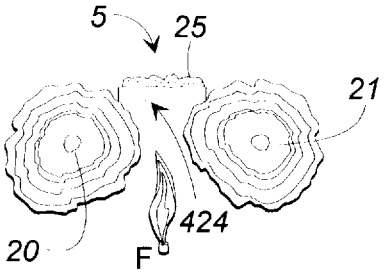
FIG. 6 is an end elevational view illustrating a planar ember bed support grate supported on a spaced pair of gas logs.
Figure 7:
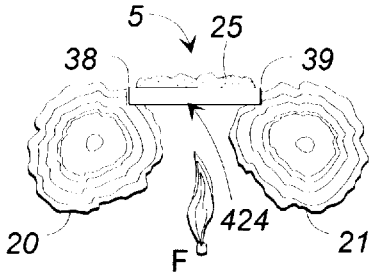
FIG. 7 is an end elevational view of a planar ember bed support grate positioned within notches formed in the opposing faces of a spaced pair of gas logs for supporting the ember bed support grate thereon.

Burner pipe 13 is provided with a combustion fuel from a fuel source, schematically illustrated as 15. The fuel source may comprise pressurized natural gas provided through a commercial gas distribution system, as well as liquid propane gas, and other fuel gases suitable for use in creating gas fires. The gas is emitted from a series of openings (not illustrated) defined within the burner pipe, and seeps upwardly through the sand bed 16, and through the embers 17, where it is combusted and forms flames F, one of which is schematically illustrated in FIGS. 1, 6 and 7, such that the flame will lap over, under, and around at least one, and here preferably two, spaced gas logs 20 and 21 positioned on a log bearing surface of log grate, 19.

Figure 2:
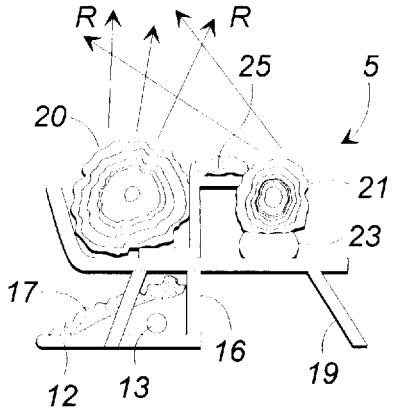
FIG. 2 is an end elevational view of the artificial gas log fire of FIG. 1, illustrating the first embodiment of the ember bed of the invention.

As shown in FIGS. 1 and 2, second log 21 is positioned atop a firebrick 23 for the purpose of raising the second log in position with respect to the first log, while yet providing the architectural or visual/aesthetic appearance of a smaller log when compared to a larger log within the fireplace. Logs 20 and 21 are spaced from one another, and will extend parallel to one another, although they need not be exactly parallel so long as they both extend in a common direction along the length of log grate 19. Moreover, although only a pair of logs 20, 21 are shown in FIGS. 1, 2, 6, and 7, it is anticipated that a plurality of logs can be stacked atop logs 20, 21, in known fashion, for creating an artificial fire within fireplace 7.

A first embodiment of artificial ember bed 5 is illustrated in FIGS. 1 and 2, in which a Z-shaped ember bed support grate 24 is positioned atop log grate 19, and has a portion extending upwardly in a space defined by, and between, logs 20, 21, with a substantially horizontal surface on which a plurality of non-combustible artificial embers 25 are disposed in any desired fashion or arrangement. It is anticipated, however, that a sufficient quantity of the artificial embers will be provided for fully covering the upper/horizontal surface of ember bed support grate 24, in all of its embodiments.

Figure 3A:
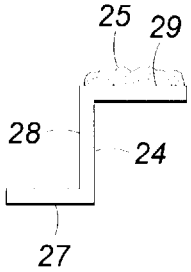
FIG. 3A is an end elevational view of the first, or Z-shaped, embodiment of the ember bed support grate of the invention.

The embodiment of the Z-shaped ember bed support grate 24 shown in FIGS. 1 and 2 is illustrated in greater detail in FIGS. 3A and B. Ember bed support grate 24 has a first generally horizontal member 27, which is adapted for being received on log grate 19. As shown in FIG. 2, first member 27 may be positioned underneath one of the gas logs, in this instance log 20, for pinning or locking the ember bed support grate in position relative to logs 20, 21. If desired, the ember bed support grate could be supported by leaning against log 21. Referring to FIG. 3A, ember bed support grate 24 also has a second member 28 extending perpendicularly from member 27, and at the end of which, opposite first member 27, a third substantially horizontal member 29 perpendicularly extends, parallel to first member 27. Third member 29 is that portion of the ember bed support grate on which the artificial embers 25 are disposed, as best shown in FIG. 2.

Figure 3B:
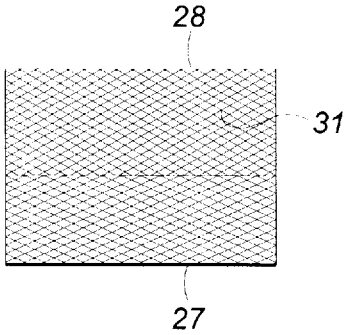
FIG. 3B is a top plan view of the ember bed support grate of FIG. 3A.

FIG. 3B illustrates a top plan view of ember bed support grate 24, in which the diamond-shaped pattern of the expanded metal grating of the ember bed support grate is illustrated, the expanded metal grating being coated with a porcelain enamel 31 for the purposes of shielding the base metal material from the open flames of the fireplace, thus improving the serviceability of the expanded metal, for example preventing corrosion through oxidation with the flame, and for improving the radiant heat performance of the ember bed support grate, and in turn the artificial fire. The embodiments of ember bed support grate 24; 124 (FIGS. 4A, B); 224 (FIG. 5A); 324 (FIG. 5B); and 424 (FIGS. 6, 7), will be fashioned of expanded metal. Moreover, each embodiment of the ember bed support grate will be porcelain enamel coated. In addition, although not shown in the Figures hereof, it is anticipated that ember bed support grate 24, in all of its embodiments shown in FIGS. 4–7, can also be fashioned of any other material suitable for forming a grating on which artificial embers 25 may be disposed, and thus the ember bed support grate could be fashioned of a ceramic material, for example a refractory cement, or other material, suitable for use in artificial fireplaces where they will be subject to high temperatures over prolonged periods of time. It is also possible that rather than using porcelain enamel to coat the expanded metal of the ember bed support grate, that it could be coated with a refractory cement, or other suitable ceramic or insulating material.

Figure 4A:
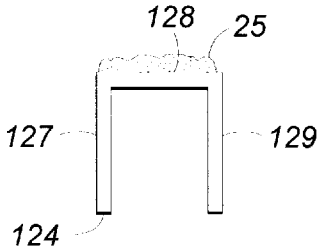
FIG. 4A is an end elevational view of a second, or C-shaped, embodiment of the ember bed support grate of the invention.
Figure 4B:
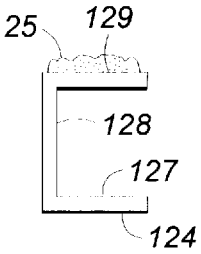
FIG. 4B is a top plan view of a second application of the C-shaped ember bed support grate of FIG. 4A.

A second embodiment of ember bed support grate 124 is shown in FIGS. 4A and B, in which the ember bed support grate has a C-shaped construction. The embodiment of ember bed support grate 124 in FIG. 4A thus has a first upwardly extending member 127, a second member 128 extending perpendicularly therefrom and in a generally horizontal plane, and on which embers 25 are disposed, and a third member 129 extending perpendicularly from second member 128 back toward what would be the surface of log grate 19, on which ember bed support grate 124 would be positioned. FIG. 4B illustrates a second embodiment of ember bed support grate 124, in which first member 127 is positioned on the log grate, and third member 129 is used as the member on which artificial embers 25 are disposed.

Figure 5A:
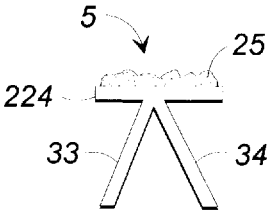
FIG. 5A is an illustration of a third embodiment of the ember bed support grate of the invention, having bifurcated legs.
Figure 5B:
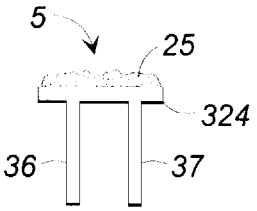
FIG. 5B is an end elevational view of a fourth embodiment of the ember bed support grate of the invention, having a pair of spaced legs.

A third embodiment of ember bed support grate 224 is illustrated in FIG. 5A, in which the ember bed support grate includes a generally planar grate member, and has a pair of bifurcated legs 33, 34 extending downwardly therefrom, sized and shaped to be received on log grate 19. A fourth embodiment of ember bed support grate 324 is shown in FIG. 5B, in which the ember bed support grate is once again a generally planar grate positioned in the space between the lower two gas logs of the fire (FIG. 2) in a generally horizontal manner by a pair of spaced legs 36, 37, both of which extend down toward the surface of the log grate.

FIGS. 6 and 7 illustrate two embodiments of ember bed support grate 424 when used without a supporting structure, for example legs or being C- or Z-shaped, by positioning the ember bed support grate 424 directly on gas logs 20, 21 as shown in FIG. 6, or by positioning the ember bed support grate 424 within notches 39 defined within the opposing faces of logs 20, 21. The notches 39 may be spaced along the length of each of logs 20, 21, or may be formed continuously along the length of the respective logs for receiving the shelf-like grate 424 therein. In addition, it is anticipated, although not illustrated, that in the embodiment of the invention of FIG. 7 the ember bed support grate 424 could be permanently fastened to logs 20, 21, for example by using a fastener sized and shaped for being exposed to high temperatures over prolonged periods of time. For example, this could be a ceramic pin or keeper, or could be a shaped piece of wire or metal coated in a porcelain enamel used to secure the grating to the logs.

Moreover, although the embodiment of the invention shown in FIGS. 1, 2, 6, 7 shows only a pair of spaced gas logs 20, 21, it is anticipated that additional ceramic gas logs could be stacked atop logs 20, 21, in any desired fashion, and that additional ember bed support grates could be positioned above ember bed support grate 24, of FIGS. 1 and 2, for example, to position additional ember beds higher within the stacked "wood" within the fireplace, as desired and as most suitable for the arrangement of the fire so fashioned.

Ceramic gas logs 20, 21 will preferably be made of a refractory cement, and will be vented (not illustrated). However, logs 20, 21, and any additional logs used to "build" the fire can be made of any suitable ceramic material which is adapted to be exposed to high temperatures over prolonged periods of time, and yet which can be fashioned to have the exterior appearance of skinned logs, logs with bark, or even split logs, as desired.

Artificial embers 25, as are embers 17, will be made of a non-combustible vitreous fiber, and thus will include those fibers known as mineral wool, man-made mineral fiber, man-made vitreous fiber, and may also include ceramic fibers, and future non-combustible fibers yet to be developed which will present the appearance of glowing embers when exposed to the flame F (FIGS. 1, 6, 7) during use of the fireplace.

A unique feature of ember bed support grate 24, and the embodiments thereof illustrated in FIGS. 3–7, in use with artificial embers 25, is that the catalytic efficiency of the fireplace will be increased by increasing the temperature within the fireplace, which has the effect of more fully combusting, if not completely combusting, the fuel of combustion which thus tends to greatly decrease the possibility of carbon or soot build-up not only on logs 20, 21, but also on the surfaces of fireplace 7, and more importantly, on the damper and flue of the fireplace. This occurs because the expanded metal of the ember bed support grate in its many embodiments will retain heat, as will the artificial embers 25, and together they act as a heat source within the fire which increases the heat of the fire to ensure complete combustion of the fuel gas used. Also, and as best shown in FIG. 2, by raising the artificial ember bed, and positioning it in the space defined between logs 20, 21, the radiant heat performance of the fireplace is improved in that the radiant heat denoted by the reference character 'R' in FIG. 2, created by ember bed 5, and in particular artificial embers 25 on the ember bed support grate, will reflect off of the surfaces of the logs 20, 21, as best shown in FIG. 2, and will also bounce or reflect off of the walls of the fireplace if the fire is constructed within a fireplace, to improve the radiant heat performance of the fire in fashion heretofore unknown in the art. This therefore has the effect of improving the thermal heat efficiency of the fire, measured in British Thermal Units (BTUs), to an extent far greater than known with fireplaces using ceramic gas logs without artificial ember bed 5. Again, all of this is made possible by the presence of a raised ember bed in the space defined by and between logs 20, 21.

That portion of the ember bed support grate which extends between logs 20, 21, for example third member 29 in FIG. 3A, member 128 in FIG. 4A, and member 129 in FIG. 4B, can extend for any desired range, based upon the desired spacing of the logs, although it is preferred that the logs be spaced somewhere in the range of from 1–8 inches apart from one another to create a more closed and compact fire and which will tend to concentrate the flame of the fire, as well as the heat and catalytic efficiency of artificial ember bed 5 in use. As shown in FIG. 3A, first member 27 of the ember bed support grate 24 may be approximately two and one-half inches long, second member 28 may be approximately three inches in length, and third member 29 may be approximately three and one-half inches in length, so that a nine-inch wide piece of expanded metal grating may be used. A preferred size of ember bed support grate 24 will thus be 9"×15". Again, however, the ultimate width, and length of the ember bed support grate will be driven by the size of the fireplace in which logs 20, 21 are used, in conjunction with artificial ember bed 5. In addition, if a stacked series of logs is used, more than one artificial ember bed 5 may be used within the fire, so that, for example, the ember beds will be positioned one above the other within the fire. It is anticipated that the ember bed support grates would tend to diminish in size the higher they are positioned within the stack of ceramic logs used to construct the fire due to the generally tapered construction of fires, in which the base of the fire is wider than the top of the fire.

So formed, artificial ember bed 5 provides the long-sought desired visual appearance of a glowing ember bed to more fully present the visual appearance of a wood fire in use. As discussed, this also has the effect of substantially improving the radiant heat performance of the fireplace, by creating an elevated heat source to reflect radiant heat off of the gas logs, as shown in FIG. 2, and creates a catalytic heat source for incinerating the carbon which would otherwise build up during the combustion process, thus minimizing the need to clean the gas logs, and/or the fireplace, over the burning season.

While several embodiments of the invention have been described above, particularly as to the various embodiments of the ember bed support grate which can be used, it is recognized that variations may be had with respect to the several embodiments of the invention. Therefore, while the invention has been disclosed in preferred forms only, it will be obvious to those skilled in the art that many additions, deletions, and modifications can be made therein without departing from the spirit and scope of the invention, and that no undue limits should be imposed thereon except as set forth in the following claims. Moreover, the corresponding structures, materials, acts, and equivalents of all means or step plus function elements in the claims are intended to include any structure, material, or act for performing the functions in combination with other claimed elements, as specifically claimed herein.

I claim:

1. An artificial ember bed for use within a fireplace, comprising:

a gas burner disposed within the fireplace;

a log grate positioned in the fireplace and spaced above said burner;

at least two artificial logs supported on said grate, said at least two logs being spaced from and substantially parallel to one another;

an ember bed support grate spaced above said grate in the space defined between said at least two logs, wherein at least a portion of said ember bed support grate is positioned above said burner; and a plurality of non-combustible embers disposed on said ember bed support grate.

2. An artificial ember bed for use within a fireplace, comprising:

a burner disposed within the fireplace;

a log grate positioned in the fireplace, said grate being spaced above said burner;

at least two artificial logs supported on said log grate, said at least two logs being spaced from one another;

an ember bed support grate spaced above said log grate in the space defined between said at least two logs; and a plurality of non-combustible embers disposed on said ember bed support grate.

3. The ember bed of claim 2, said ember bed support grate comprising a first member constructed and arranged to be received on the log grate, a second member extending perpendicularly away from said first member, and a third member extending perpendicularly away from said second member, said third member being spaced from and parallel to said first member.

4. The ember bed of claim 3, wherein said ember bed support grate is Z-shaped.

5. The ember bed of claim 3, wherein said ember bed support grate is C-shaped.

6. The ember bed of claim 2, wherein said ember bed support grate comprises a planar grate supported on and extending between said at least two logs.

7. The ember bed of claim 2, wherein each of said at least two logs has at least one grate receiving notch defined therein, each said notch being constructed and arranged to receive a portion of said ember bed support grate therein, and wherein said ember bed support grate comprises a planar grate received within said respective grate receiving notches.

8. The ember bed of claim 2, wherein said ember bed support grate includes a pair of spaced legs extending away therefrom.

9. The ember bed of claim 2, wherein said ember bed support grate includes a pair of bifurcated legs extending away therefrom.

10. The ember bed of claim 2, wherein said ember bed support grate comprises an expanded metal grate.

11. The ember bed of claim 2, wherein said ember bed support grate is coated with a porcelain enamel material.

12. The ember bed of claim 2, wherein said non-combustible embers comprise a non-combustible material selected from one of the group of non-combustible materials consisting of vitreous fiber, mineral wool, man-made mineral wool, man-made vitreous fiber, and ceramic fiber.

13. The ember bed of claim 2, wherein said ember bed support grate extends for a distance between said at least two logs in the range of from one to eight inches.

14. The ember bed of claim 2, wherein said burner comprise a gas burner, and wherein said ember bed is constructed and arranged to act as a catalytic heat source for preventing the build up of carbon on said at least two logs resulting from incomplete combustion of gas by the burner.

15. The ember bed of claim 2, wherein said ember bed is constructed and arranged to reflect radiant heat off of said at least two logs for improving BTU emissions from the fireplace.

16. The ember bed of claim 2, wherein each of said at least two logs comprises a vented, refractory cement gas log.

17. An artificial ember bed for use within a fireplace, the fireplace having a burner, a log grate spaced above the burner, and at least two artificial logs spaced from one another and being supported on the log grate, said artificial ember bed comprising:

an ember bed support grate spaced above the log grate in the space defined between the at least two artificial logs; and a plurality of non-combustible embers disposed on said ember bed support grate.

* * * * *